US010578991B2

(12) United States Patent
Mizukoshi et al.

(10) Patent No.: US 10,578,991 B2
(45) Date of Patent: Mar. 3, 2020

(54) IMAGE FORMING APPARATUS HAVING NIP PORTION HOLDING RECORDING MATERIAL BETWEEN TRANSFER MEMBER AND IMAGE BEARING MEMBER

(71) Applicant: CANON KABUSHIKI KAISHA, Tokyo (JP)

(72) Inventors: Shunsuke Mizukoshi, Tokyo (JP); Makoto Fukatsu, Suntou-gun (JP); Yuta Isobe, Kawasaki (JP); Shuhei Tokiwa, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/250,385

(22) Filed: Jan. 17, 2019

(65) Prior Publication Data

US 2019/0227453 A1 Jul. 25, 2019

(30) Foreign Application Priority Data

Jan. 19, 2018 (JP) ..... 2018-007277

(51) Int. Cl.
*G03G 15/02* (2006.01)
*G03G 15/16* (2006.01)

(52) U.S. Cl.
CPC ..... *G03G 15/0266* (2013.01); *G03G 15/1665* (2013.01); *G03G 15/1675* (2013.01)

(58) Field of Classification Search
CPC ..... G03G 15/0266; G03G 15/1665; G03G 15/1675
USPC ..... 399/50, 66
See application file for complete search history.

(56) References Cited

U.S. PATENT DOCUMENTS 6,654,570 B2 * 11/2003 Kato ..... G03G 15/1675 399/66
10,324,400 B2 * 6/2019 Matsuura ..... G03G 15/1675

FOREIGN PATENT DOCUMENTS

JP 10-78712 A 3/1998
JP 2007-232881 A 9/2007
JP 2009-181073 A 8/2009

* cited by examiner

*Primary Examiner* — William J Royer
(74) *Attorney, Agent, or Firm* — Canon U.S.A., Inc. IP Division

(57) ABSTRACT

A nip portion is formed between a transfer member and an image bearing member. During an image transfer operation, a first transfer voltage is applied so that a first charging voltage is applied to the surface of the image bearing member forming the nip portion. Before paper enters, a second transfer voltage is applied so that a third charging voltage is applied to the surface of the image bearing member forming the nip portion. A void is formed by the image bearing member, the transfer member and the paper within the nip portion. Before an image transfer operation and the void is formed, one of the first and second transfer voltages and a third transfer voltage is applied so that a second charging voltage having a same polarity as the first charging voltage and being lower in absolute value is applied to the surface of the image bearing member.

20 Claims, 8 Drawing Sheets

IMAGE FORMING APPARATUS HAVING NIP PORTION HOLDING RECORDING MATERIAL BETWEEN TRANSFER MEMBER AND IMAGE BEARING MEMBER

BACKGROUND OF THE INVENTION

Field of the Invention

A disclosed aspect of the embodiments relates to an image forming apparatus, such as an electrophotographic printer and an electrophotographic copier, configured to form an image on a recording material.

Description of the Related Art

Conventionally, image forming apparatuses such as a copier and a printer may often apply an electrostatic recording method, an electrophotographic recording method, and so on.

As one of such recording methods, a direct transfer method has been known which transfers a toner image formed on a surface of a photosensitive member onto a recording material conveyed to between the photosensitive member and a transfer member in a transfer part based on a potential difference occurring between a photosensitive member and a transfer member.

However, when such a direct transfer method is used and if a transfer bias is applied when a recording material does not exist at a nip portion (transfer contact portion) between the photosensitive member and the transfer member, a large potential difference may occur between the transfer member and the photosensitive member, which causes abnormal discharge. Thus, a defective image may be generated. In order to prevent such abnormal discharge, Japanese Patent Laid-Open No. 10-78712 discloses a method for reducing abnormal discharge by reducing the transfer bias to be applied when the nip portion does not have a recording material so that excessive discharge can be prevented.

However, when the method disclosed in Japanese Patent Laid-Open No. 10-78712 is used, the following problems may disadvantageously occur. When a recording material enters to the nip portion and if a leading edge of the recording material is caught between the photosensitive member and the transfer member, the photosensitive member, the transfer member, and the recording material form a void in the transfer contact part due to the thickness of the recording material. If the void is formed, a potential difference between the photosensitive member and the transfer member may cause abnormal discharge in the void. A preparation for image forming has started when such a void is formed, and when a transfer bias for image forming is applied, discontinuous discharge occurs between the photosensitive member and the transfer member at the void, which may cause minute unevenness in potential on the surface of the photosensitive member. When charging cannot level the minute unevenness in potential, a defective image may be generated. This abnormal discharge becomes more significant when the transfer bias is high, like a case where a recording material does not exist in the nip portion between the transfer member and the photosensitive member.

The contact state between the photosensitive member transfer member and the recording material with the void also has an influence on the resulting image. While a recording material is caught between the photosensitive member and the transfer member and image forming is being performed, the potential difference of the surface potentials of the transfer member and the photosensitive member transfers the toner image to the recording material. In this case, transfer current fed from the transfer member to the photosensitive member has an influence to change the surface potential of the photosensitive member after passing through the transfer nip. The photosensitive member while passing through the transfer nip receives a uniform influence from the transfer member while the image is being transferred from the photosensitive member to the recording material. This generates a uniform surface potential of the photosensitive member under the influence of the transfer. Therefore, an adverse effect in an image does not occur. On the other hand, because transfer current is not fed from the transfer member to the surface of the photosensitive member, uneven surface potential occurs on the photosensitive member after passing through the transfer nip between the void and the remaining even part. When charging cannot level the unevenness in potential, a defective image may sometimes be generated.

SUMMARY OF THE INVENTION

The present disclosure was made for solving at least one of those problems and can provide an image forming apparatus which can prevent a defective image generated because of the unevenness in potential due to the abnormal discharge and a potential difference on the photosensitive member surface.

According to a first aspect of the embodiments, an image forming apparatus includes a rotatable image bearing member; a charging member configured to charge a surface of the image bearing member; a transfer member configured to transfer a toner image formed on the surface of the image bearing member onto a recording material; a charging voltage applying unit configured to apply charging voltage to the charging member; a transfer voltage applying unit configured to apply transfer voltage to the transfer member; and a control unit configured to control voltage to be applied from the charging voltage applying unit and the transfer voltage applying unit and a printing operation. A nip portion is configured to hold the recording material is formed between the transfer member and the image bearing member. The control unit controls the charging voltage and the transfer voltage to be applied by the charging voltage applying unit and the transfer voltage applying unit during a period from start of an operation for forming the toner image onto the image bearing member to completion of an operation for transferring the toner image onto the recording material. The charging voltage applying unit is capable of applying to the charging member a first charging voltage, a second charging voltage having a same polarity as that of the first charging voltage and being lower in absolute value than the first charging voltage, and a third charging voltage being equal to or higher in absolute value than the second charging voltage. The transfer voltage applying unit is capable of applying to the transfer member a first transfer voltage and a second transfer voltage being equal to 0 V or having a same polarity as that of the first transfer voltage and being lower in absolute value than the first transfer voltage. While the toner image is being transferred onto the recording material at the nip portion, the transfer voltage applying unit applies the first transfer voltage to the transfer member, and the surface of the image bearing member forming the nip portion has a potential when the charging voltage applying unit applies the first charging voltage to the charging member. Before a leading edge of the recording material enters to the nip portion, the transfer voltage applying unit applies the second transfer voltage to the transfer member, and the surface of the image bearing member in contact with the transfer member has a potential when the charging voltage applying unit applies the third charging voltage to the charging member. When the leading edge of the recording material is present within the nip portion after the leading edge of the recording material enters to the nip portion, a void is formed by the surface of the image bearing member, a surface of the transfer member and the leading edge of the recording material within the nip portion, and during a period before the toner image is transferred to the recording material at the nip portion and until the void is formed, the transfer voltage applying unit applies to the transfer member the first transfer voltage, the second transfer voltage, or a third transfer voltage having a magnitude between the first transfer voltage and the second transfer voltage, and the surface of the image bearing member forming the void has a potential when the charging voltage applying unit applies the second charging voltage to the charging member.

Further features of the disclosure will become apparent from the following description of exemplary embodiments with reference to the attached drawings.

DESCRIPTION OF THE EMBODIMENTS

With reference to drawings, modes for embodying the present disclosure will be exemplarily described in detail based on embodiments. However, it should be understood that dimensions, quality, shapes and relative arrangement of components according to embodiments may be changed in accordance with the configuration and conditions of an apparatus to which the disclosure is applied. In other words, it is not intended that the scope of the disclosure is limited to the following embodiments. In the following, some parameters use specific values for distance, length, speed, electrical properties (e.g., resistivity, voltage). These specific values are mainly for illustrative purposes. They may be specified within some tolerance, such as ±5%, or according to standard industrial practice.

Embodiment 1

Figure 1:
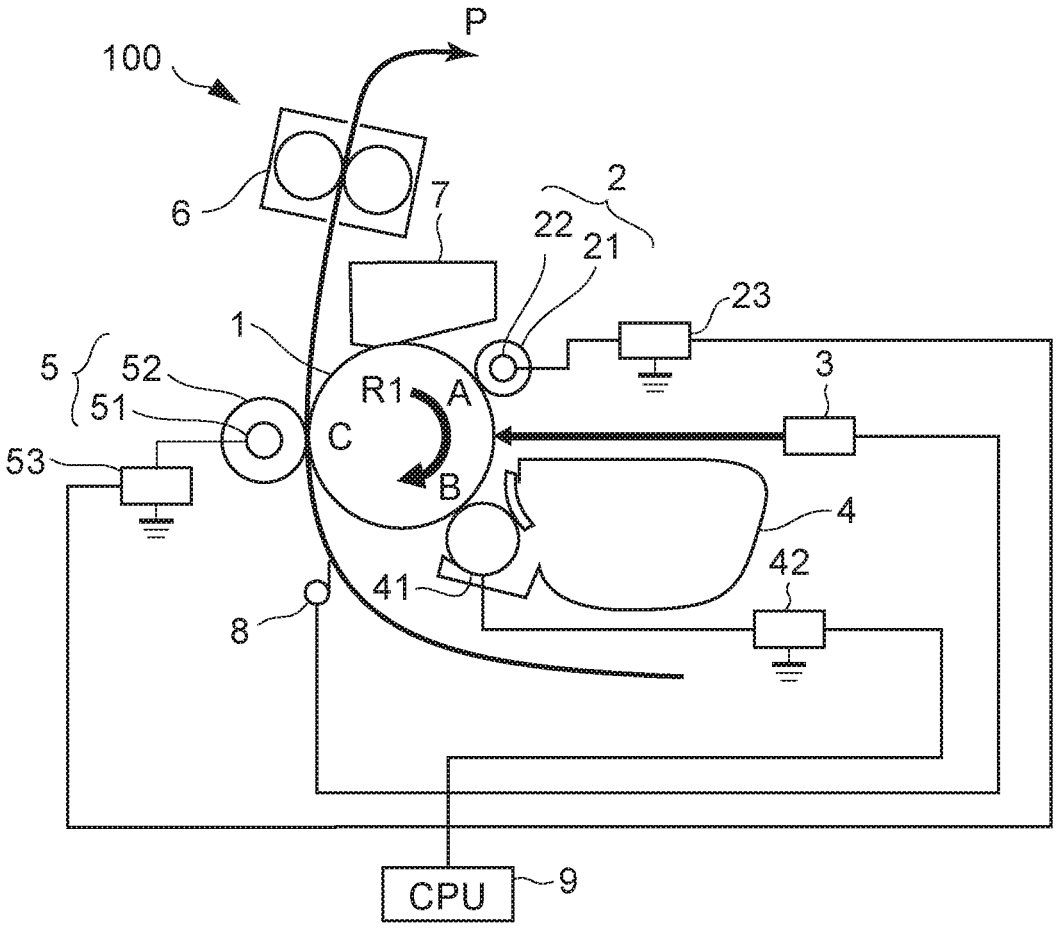
FIG. 1 is a schematic cross-sectional view illustrating a configuration of an image forming apparatus according to Embodiment 1.

With reference to FIG. 1, a configuration of an image forming apparatus 100 according to Embodiment 1 will be described, and image forming processing according to Embodiment 1 will be described. FIG. 1 is a schematic cross-sectional view illustrating a configuration of the image forming apparatus 100 according to Embodiment 1.

As illustrated in FIG. 1, the image forming apparatus 100 according to Embodiment 1 includes a photosensitive drum 1 as a rotatable image bearing member, a charging roller 2 in contact with the photosensitive drum 1 as a charging member, an exposure device 3 as an exposure unit, a developing device 4, and a transfer roller 5 as a transfer unit. The image forming apparatus 100 further includes a fixing device 6, a cleaning device 7, a recording-material detecting member 8 as a recording-material-conveyance detecting unit, and a controller 9 as a central processing unit (CPU) operating as a control unit.

The photosensitive drum 1 has a diameter Φ of 24 mm and is configured to rotate at a rotation speed of 100 mm/sec in a direction indicated by an arrow R1.

The charging roller 2 is a single-layer roller having a conductive core metal 21 and a conductive rubber layer 22 and has a volume resistivity of $10^3$ to $10^6$Ω*cm. The charging roller 2 is in contact with the photosensitive drum 1 at a charging contact position A and rotates about the conductive core metal 21 in association with the rotation of the photosensitive drum 1. A charging voltage applying unit 23 is connected to the conductive core metal 21 and is capable of applying direct current voltage (charging bias) having a negative polarity.

The developing device 4 internally contains a toner (developer) having a negative polarity and includes a developing sleeve 41 (developer bearing member). The developing sleeve 41 bears a toner internally contained in the developing device 4 and is in proximity with the photosensitive drum 1 with a predetermined clearance therebetween at a development proximity position B. A development voltage applying unit 42 is connected with developing sleeve 41 and is capable of applying alternating-current voltage (development bias).

The transfer roller 5 is a roller member including a conductive core metal 51 and a conductive urethane foam layer 52 having an elastic pressure contact part against the photosensitive drum 1. The transfer roller 5 has a volume resistivity of $10^7$ to $10^{10}$ Ω*cm and is in contact with the photosensitive drum 1 at a transfer contact position (transfer nip portion) C when a recording material P does not exist therebetween and is configured to rotate about the conductive core metal 51 in association with the rotation of the photosensitive drum 1. A transfer voltage applying unit 53 is connected with the conductive core metal 51 and is capable of applying voltage (transfer bias) having a positive polarity.

In the circumferential direction of the photosensitive drum 1, the distance from the charging contact position A to the development proximity position B is equal to 20 mm, and the distance from the development proximity position B to the transfer contact position C is equal to 30 mm.

The controller 9 is configured to exchange electrical information with a host apparatus and to overall control image forming operations performed by the image forming apparatus 100 in accordance with a predetermined control program and reference tables. For example, biases to be applied to the charging roller 2, the developing sleeve 41 and the transfer roller 5 by the charging voltage applying unit 23, the development voltage applying unit 42 and the transfer voltage applying unit 53 are controlled by the controller 9. The image forming apparatus 100 performs image forming on a recording material P (hereinafter, simply called "paper") having a sheet-like shape, for example, based on an electrical image signal input from the host apparatus to the controller 9. The host apparatus may be an image reader (document image reading unit), a personal computer (PC), a facsimile, a smart phone or the like.

A surface of the rotating photosensitive drum 1 is charged with a charging bias of a negative polarity, which is applied to the charging roller 2, uniformly to a predetermined potential. Then, the photosensitive drum 1 is exposed to a laser beam emitted from the exposure device 3 so that an electrostatic latent image is formed thereon. After that, because of a development bias applied to the developing sleeve 41, toner is moved from the developing sleeve 41 to the surface of the photosensitive drum 1 so that the electrostatic latent image is visualized, and, as a result, a toner image (developer image) is formed. The toner image formed on the photosensitive drum 1 is transferred onto the paper because of a transfer bias of a positive polarity applied to the transfer roller 5. The toner image transferred onto the paper is fixed to the paper through pressing and heating by the fixing device 6, resulting in a final image. Then, the operation is completed.

In the toner image formed on the photosensitive drum 1, partial toner that is left without being transferred to the paper is conveyed to the cleaning device 7 and is scraped off from the surface of the photosensitive drum 1.

The recording-material detecting member 8 is placed between a feeding unit, not illustrated, and the transfer contact position C for conveying paper, and the leading edge and the back end position (conveyance timing) of the conveyed paper in the conveyance direction are detected by a sensor, and information thereon is transmitted to the controller 9. Based on the obtained conveyance timing information, the controller 9 controls times for bias application to the charging roller 2, the developing sleeve 41 and the transfer roller 5.

Relationship Between Applied Bias and Adverse Effect in Image

Before describing control over biases to be applied for a print job, that is a feature of the present disclosure, how the level of an adverse effect in an image changes when the transfer bias and the charging bias are changed will be described first with reference to Table 1.

TABLE 1

| Affecting Transfer Bias Application Timing Charging Bias Difference | | Adverse Effects in Image: Density Image-Forming Period | Black Spots Non-Paper-Feeding Period/ Paper Leading-Edge Reaching Time Δ0 V | Black Spots Δ50 V | Unevenness in Potential Δ0 V | Unevenness in Potential Δ50 V | Desirable Setting Range At Each Time | Bias Difference [%] Between Image-Forming Period And Non-Paper-Feeding Period |
|---|---|---|---|---|---|---|---|---|
| Transfer Bias [V] | 600 | C | A | A | C | C | Non-Paper-Feeding Period/ Paper Leading-Edge Reaching Time | 0 |
| | 800 | C | A | A | C | C | | 14 |
| | 1000 | C | B | A | C | B | | 29 |
| | 1200 | C | B | A | C | B | | 43 |
| | 1400 | C | B | B | B | A | | 57 |
| | 1600 | B | C | B | B | A | | 71 |
| | 1800 | B | C | B | A | A | | 86 |
| | 2000 | B | C | C | A | A | | 100 |
| | 2200 | A | C | C | A | A | Image-Forming Period | |
| | 2400 | A | C | C | A | A | | |

Table 1 illustrates adverse effects in an image including three types of density, black spots and unevenness in potential. Table 1 further illustrates timing for application of a transfer bias to have an influence on an adverse effect in an image.

Figure 2A:
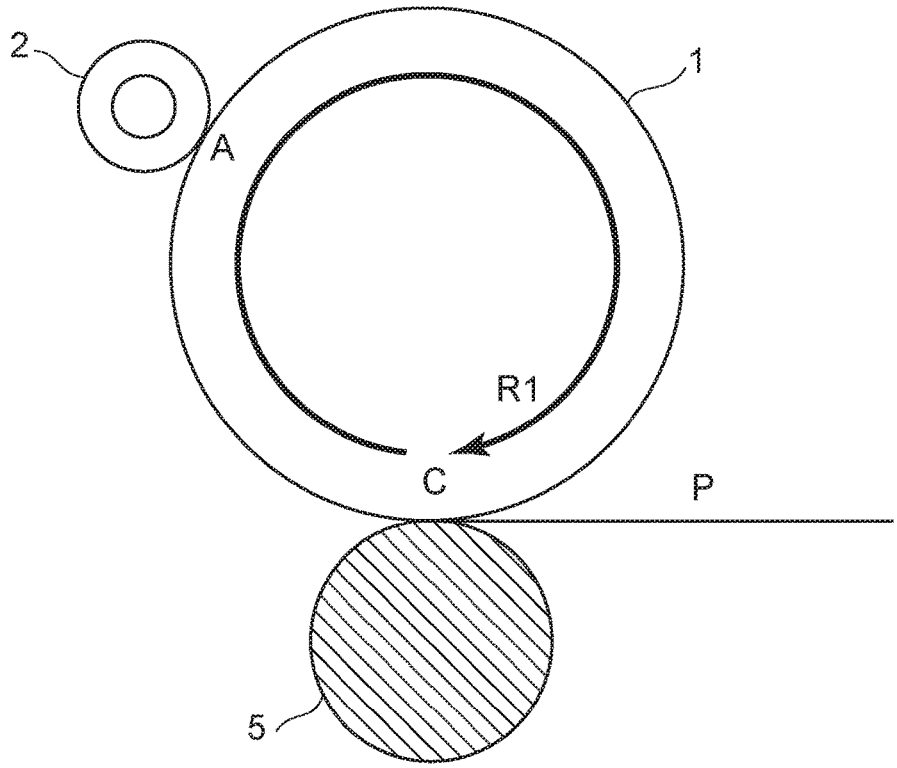
FIG. 2A is a schematic diagram illustrating a state that a recording material is conveyed to a transfer nip portion of an image bearing member and a transfer member according to Embodiment 1.
Figure 2B:
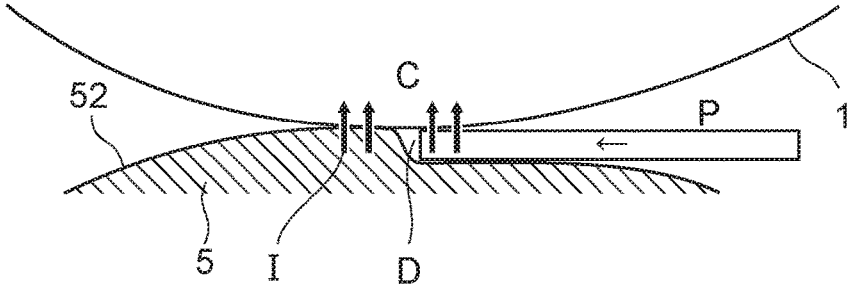
FIG. 2B is a schematic diagram illustrating the transfer nip portion according to Embodiment 1.
Figure 2C:
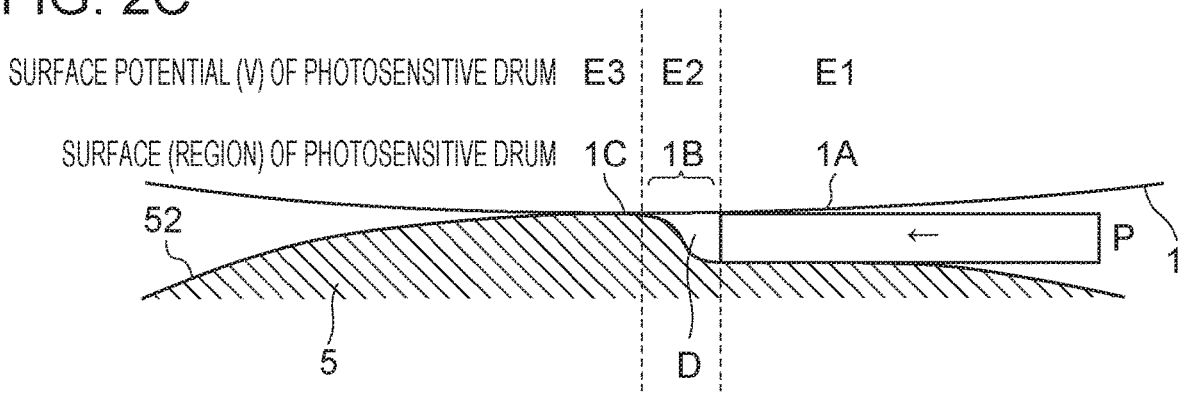
FIG. 2C is a schematic diagram illustrating a void of the transfer nip portion according to Embodiment 1.

First, with reference to FIGS. 2A to 2C, a positional relationship among paper P, the photosensitive drum 1 and the transfer roller 5 in association with transfer bias application timing will be clarified and will be described in order. FIG. 2A is a schematic diagram illustrating a positional relationship among the photosensitive drum 1, the charging roller 2, and the transfer roller 5 when the leading edge of the paper P reaches the transfer contact position C. FIG. 2B is a schematic enlarged diagram of a neighborhood (within the transfer nip portion) of the transfer contact position C in FIG. 2A. The term "image-forming period" in Table 1 refers to a period from a time when a back end of a margin at the paper leading edge illustrated in FIG. 2A reaches the transfer contact position C to a time when the leading edge of the paper back end margin reaches the transfer contact position C. In other words, it refers to a period when a toner image can be transferred to paper. The term "non-paper-feeding period" refers to a period when paper P is not conveyed to the transfer contact position C and when the photosensitive drum 1 and the transfer roller 5 are in contact with each other at the transfer contact position C. In addition, the term "paper leading-edge reaching time" refers to a time when the leading edge of the conveyed paper P reaches the transfer contact position C and when the paper P is present at a part of the transfer contact position C. FIG. 2B illustrates a time when a void is formed at the transfer contact position C by the leading edge of the paper P and the photosensitive drum 1 and the transfer roller 5. The void will be described below. The same is true below regarding those periods and times, and the term "paper leading-edge reaching time" described below is defined in the same manner as that of the aforementioned paper leading-edge reaching time.

Next, adverse effects in an image will be described. Referring to Table 1, the term "density" represents a density of a solid black patch, and superiority and inferiority for transfer efficiency when a predetermined amount of toner is stacked on a surface of the photosensitive drum 1. Therefore, the transfer bias applied during the image-forming period has an influence on the density. Black spots caused by discharging at concaves and convexes of a surface of the conductive urethane foam layer 52 of the transfer roller 5 and a gap caused by a contact between the photosensitive drum 1 and the transfer roller 5 (or between the photosensitive drum 1 and the transfer roller 5 before and after the transfer contact position C). This is a phenomenon that minute spots may occur on an image because it is not easy to fully level unevenness in potential caused by abnormal discharging occurring between the surface of the photosensitive drum 1 and the transfer roller 5 while charging. The phenomenon of unevenness in potential and details of a charging bias difference illustrated under the item "Unevenness in Potential" on Table 1 will be described below.

The image quality when the transfer bias and the charging bias are changed against those adverse effects in an image is evaluated based on three levels of "A", "B" and "C". "A" represents a level indicating sufficient quality without problem, and "C" represents a level indicating significantly low image quality. "B" represents a level indicating quality with a slight adverse effect in an image but without a practical problem.

Next, dependence of the transfer bias will be described.

Referring to Table 1, first of all, with respect to the density, the image quality level increases as the transfer bias increases. This simply means that the transfer efficiency increases as the transfer bias increases. Therefore, the transfer bias to be applied during an image-forming period may be equal to or higher than 2200 V, resulting in a density of the level "A".

Contrarily, black spots are improved as the transfer bias is reduced. This is because the potential difference between the surface of the photosensitive drum 1 and the transfer roller 5 decreases as the transfer bias is reduced, preventing easy occurrence of an abnormal discharge phenomenon. In view of this, the transfer bias to be applied during a non-paper-feeding period may be equal to or lower than 800 V, resulting in black spots of the level "A".

Next, the unevenness in potential will be described. The term "unevenness in potential" refers to a phenomenon that a part after the leading edge of paper by one circumferential length of the photosensitive drum 1 made lighter, appearing as white streaks, in a case where an image of halftone, for example, is output. With reference to FIG. 2B, a mechanism for causing such unevenness in potential will be described. For a print job, a charging bias of a negative polarity may be applied to the charging roller 2 to charge the surface of the photosensitive drum 1 to a negative polarity while a transfer bias of a positive polarity is applied to the transfer roller 5. Thus, transfer current I of the positive polarity is fed from the transfer roller 5 to the photosensitive drum 1, as indicated by the arrows in FIG. 2B. This transfer current I results in a low absolute value of the surface potential of the photosensitive drum 1 charged to the negative polarity. While the paper P and the photosensitive drum 1 have predetermined rigidities, the conductive urethane foam layer 52 of the transfer roller 5 has a lower rigidity. Therefore, in a case where the paper P is conveyed to the transfer contact position C, a void as illustrated in FIG. 2B occurs among the photosensitive drum 1, the conductive urethane foam layer 52, and the leading edge of the paper P because of the thickness of the paper P. A part including and around the void is called a void portion D. When the void occurs, it is hard for the transfer current I to flow in the void portion D, preventing a part of the surface potential of photosensitive drum 1 to have a small absolute value. This part results in unevenness in potential. In a case where the photosensitive drum 1 rotates in a direction R1 in FIG. 2A and the unevenness in potential is not sufficiently leveled with the charging bias applied from the charging roller 2, horizontal white streaks occur at a position after a paper leading edge by one circumferential length (or 75 mm below the paper leading edge according to this embodiment) of the photosensitive drum 1. This is the mechanism for causing the unevenness in potential.

On the other hand, the void portion D has a void between the photosensitive drum 1 and the transfer roller 5, and an abnormal discharge phenomenon may therefore easily occur. In other words, black spots as described above may easily occur.

Referring back to Table 1, it is found that the unevenness in potential is improved as the transfer bias at a paper leading-edge reaching time increases. This is because a large difference between the surface potential of the photosensitive drum 1 and the charging bias in an area before charged (an area between the transfer contact position C and the charging contact position A in the circumferential direction of the photosensitive drum 1) results in a higher effect for leveling the unevenness in potential. In other words, increased transfer current of a positive polarity fed from the transfer roller 5 to the photosensitive drum 1 results in a lower absolute value of the surface potential of the photosensitive drum 1 at the area before charged, which increases the difference between the surface potential of the photosensitive drum 1 and the potential of the charging roller 2. Thus, the transfer bias is increased by a predetermined charging bias, improving the unevenness in potential.

On the other hand, black spots deteriorate as the transfer bias increases, as described above. This is because a larger transfer bias easily causes an abnormal discharge in the void because of the potential difference between the photosensitive drum 1 and the transfer roller 5.

Therefore, the transfer bias to be applied to the void portion D is to be defined in view of the balance between the unevenness in potential and the black spots.

Next, advantages of the charging bias will be described. In view of results on Table 1, as the charging bias difference increase, the range for improving black spots and unevenness in potential increases. With reference to FIG. 2C, the charging bias difference will be described. FIG. 2C is an enlarged schematic diagram of a neighborhood (within the transfer nip portion) of the transfer contact position C in FIG. 2B. A region 1A is a region of the surface of the photosensitive drum 1 in FIG. 2C, which is to be in contact with paper P. A region 1B is a region having the void portion D in the surface of the photosensitive drum 1, and a region 1C is a region of the surface of the photosensitive drum 1, which is to be in contact with the transfer roller 5. The regions 1A, 1B, and 1C have potentials E1 (V), E2 (V), and E3 (V), respectively. The term "charging bias difference" refers to a difference between a charging bias applied in advance to the region to be the region 1B in the surface of the photosensitive drum 1 having the void portion D and a charging bias applied when the region 1B reaches the charging contact position A again. In other words, the charging bias to be applied when the region 1B reaches the charging contact position A again is a charging bias during the image-forming period. The charging bias difference Δ is expressed by Equation (1).

$$\text{Charging Bias Difference } \Delta = |V1| - |V2| \quad (1)$$

where |V1|>|V2| and where V1 (V) is a charging bias to be applied when region 1B of the surface of the photosensitive drum 1 having the void portion D reaches the charging contact position A again and V2 (V) is a charging bias to be applied in advance to a region to be the region 1B.

The charging bias V2 applied to the region 1B of the photosensitive drum 1 having the void portion D is advantageously lower in absolute value than the charging bias V1 when the region 1B of the photosensitive drum 1 having the void portion D reaches the charging contact position A again for the following reasons. Because it is hard for the transfer current I to flow through the region 1B of the photosensitive drum 1 having the void portion D, the region 1B is hardly influenced by the transfer bias. Therefore, the potential of the region 1B of the photosensitive drum 1 having the void portion D after passing by the transfer contact position C is higher in absolute value than the surface potentials of the regions 1A and 1C of the photosensitive drum 1 without the void portion D, resulting in unevenness in potential. In a case where re-charging thereto by the charging roller 2 cannot level the unevenness in potential, there is a possibility that the unevenness in potential may cause a defective image. Accordingly, the absolute value of the potential of the region 1B after passing by the transfer contact position C is to be low to get closer to the potential of the regions 1A and 1C after passing by the transfer contact position C. In order to achieve this, the charging bias V2 applied to the region 1B of the photosensitive drum 1 having the void portion D is reduced to be lower in absolute value than the charging bias V1 when the region 1B of the photosensitive drum 1 reaches again the charging contact position A. This can, in advance, keep a low surface potential E2 in absolute value of the region 1B of the photosensitive drum 1 having the void portion D.

Therefore, in order to obtain an even surface potential of the photosensitive drum 1 after the image transfer, it is important to have a large difference between the charging bias V2 applied to the region 1B of the photosensitive drum 1 having the void portion D and the charging bias V1 when the region 1B reaches again the charging contact position A. The large charging bias difference can provide a larger potential difference between the surface potential of the photosensitive drum 1 and the charging roller 2. Thus, the unevenness in potential can be improved.

In order to prevent an abnormal discharge causing black spots as much as possible in the void portion D, it is important to have a small potential difference between the surface potential E2 of the region 1B of the photosensitive drum 1 and the transfer roller 5 forming the void portion D. This can be achieved by a smaller absolute value of the surface potential E2 of the region 1B in the surface of the photosensitive drum 1 than that of the surface potential E1 of the region 1A or the surface potential E3 of the region 1C. Therefore, a larger charging bias difference can produce a smaller potential difference between the surface potential E2 of the photosensitive drum 1 and the transfer roller 5 in the region 1B forming the void portion D. As a result, an abnormal discharge can be prevented.

For checking influences of charging bias differences, Table 2 illustrates charging bias dependence characteristics of black spots and unevenness in potential.

TABLE 2

| Affecting Transfer Bias Application Timing Charging Bias | | Black Spots | | | | | Unevenness in Potential | | | | | Desirable Setting Range At Each | Bias Difference [%] Between Image-Forming Period And Non-Paper- |
|---|---|---|---|---|---|---|---|---|---|---|---|---|---|
| | | Paper Leading-Edge Reaching Time | | | | | | | | | | | |
| Difference | | Δ0 V | Δ25 V | Δ50 V | Δ75 V | Δ100 V | Δ0 V | Δ25 V | Δ50 V | Δ75 V | Δ100 V | Time | Feeding Period |
| Transfer Bias [V] | 600 | A | A | A | A | A | C | C | C | C | B | | |
| | 800 | A | A | A | A | A | C | C | C | B | B | | 0 |
| | 1000 | B | A | A | A | A | C | C | B | B | A | Leading- | 14 |
| | 1200 | B | B | A | A | A | C | B | B | A | A | Edge | 29 |
| | 1400 | B | B | B | A | A | B | B | A | A | A | Reaching | 43 |
| | 1600 | C | B | B | B | A | B | A | A | A | A | Time | 57 |
| | 1800 | C | C | B | B | B | A | A | A | A | A | | 71 |
| | 2000 | C | C | C | B | B | A | A | A | A | A | | 86 |
| | 2200 | C | C | C | C | B | A | A | A | A | A | Image- | 100 |
| | 2400 | C | C | C | C | C | A | A | A | A | A | Forming Period | |

In view of the results on Table 2, when a predetermined transfer bias is applied, the black spots and unevenness in potential can be prevented as the charging bias difference increases.

The black spots are improved with a larger charging bias difference, that is, when the absolute value of the surface potential E2 of the region 1B in the photosensitive drum 1 at the void portion D is reduced for a smaller potential difference from the transfer roller 5, which can prevent an abnormal discharge as a result.

The unevenness in potential, like the black spots, is also improved with a larger charging bias difference that is, with a smaller difference between the surface potential E2 of the region 1B having formed the void portion D of the photosensitive drum 1 and the surface potential of the surface of the photosensitive drum 1 having formed a contact nip with the transfer roller 5 to perform image forming. In general, as the transfer bias decreases, the transfer current I also decreases. Thus, the photosensitive drum 1 changes slightly in its surface potential even having undergone image transfer. This means a smaller advantage of leveling the unevenness in surface potential of the photosensitive drum 1 with the discharge by the charging bias. As a result, a potential difference easily occurs on the surface of the photosensitive drum 1, which easily causes unevenness in potential. Accordingly, the charging bias difference can be increased so that the absolute value of the surface potential E2 of the region 1B in the photosensitive drum 1 having the void portion D can be reduced in advance, which can reduce the influence of the unevenness in potential. This increases the range of the transfer bias which can be used without causing an adverse effect in an image due to the unevenness in potential.

Therefore, the black spots and the unevenness in potential are improved with a larger charging bias difference. The black spots can be improved with a smaller transfer bias. The unevenness in potential can be improved with a larger transfer bias.

Figure 3:
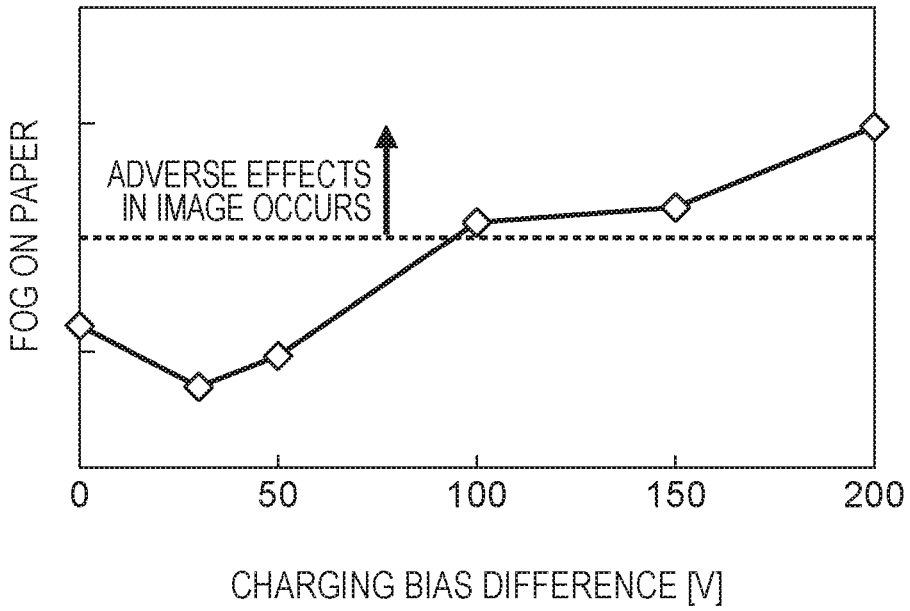
FIG. 3 is a graph illustrating a relationship between charging bias difference and fog according to Embodiment 1.

On the other hand, when the charging bias difference is excessively increased, an adverse effect in an image called a fog occurs. The fog is a phenomenon that a toner charged to a normal polarity with respect to a region which is not exposed for performing image forming or toner charged to the opposite polarity is unintentionally developed on a surface of the photosensitive drum 1. The fog may often occur when the potential difference between the development bias and the surface potential of the photosensitive drum 1 is not set in a proper range. As described above, a larger charging bias difference causes a lower absolute value of the surface potential E2 of the region 1B in the photosensitive drum 1 having the void portion D than the absolute values of the surface potentials E1 and E3 of the regions 1A and 1C in the photosensitive drum 1. Therefore, a smaller difference between the development bias and the surface potential of the photosensitive drum 1 can cause the toner of the normal polarity to be developed on the surface of the photosensitive drum 1, which causes a fog. FIG. 3 is a graph illustrating a relationship between charging bias difference and the fog. As the charging bias difference increases, the amount of fog developed on the surface of the photosensitive drum 1 increases. Particularly, it is found that when the charging bias difference is higher than 100 V, the adverse effect in an image occurs. On the other hand, in a region with a potential difference equal to or lower than 50 V, occurrence of the fog can be prevented in particular. Therefore, the charging bias difference may be set to 50 V that is a region where occurrence of the fog can be prevented and may further be set such that occurrence of black spots and unevenness in potential can be prevented.

However, there may be some cases where reduction of the charging bias V2 forming the surface potential E2 of the region 1B in the photosensitive drum 1 having the void portion D (hereinafter, called a void-portion charging bias) for eliminating the charging bias difference does not provide the advantage of improvement of the unevenness in potential. A charging bias forming the surface potential E3 in the region 1C of the photosensitive drum 1 at the transfer contact position C during a non-paper-feeding period (hereinafter, called a non-paper-feeding period charging bias) may be lower in absolute value than the void-portion charging bias V2. In this case, with a lower absolute value of the potential E3 in the region 1C of the photosensitive drum 1 during a non-paper-feeding period may be lower in absolute value than the potential E2 of the region 1B in the photosensitive drum 1 at the void portion D even when charging is performed again. As a result, unevenness in potential due to the surface potential difference on the photosensitive drum 1 may occur. Therefore, it is important that the non-paper-feeding period charging bias is equal to or higher in absolute value than the void-portion charging bias V2. In order to prevent an abnormal discharge, the non-paper-feeding period having a low transfer bias less varies in surface potential of the photosensitive drum 1 after an image transfer is influenced than that during the image-forming period. Therefore, from a viewpoint of unevenness in potential, it may be important that the surface potential E3 of the region 1C in the photosensitive drum 1 during the non-paper-feeding period is lower in absolute value than the surface potential E1 of the region 1A in the photosensitive drum 1 at the transfer contact position C during the image-forming period. Because black spots are improved with a reduced absolute value of a charging bias, a charging bias may be selected from a range that does not have an influence on image forming, which does not have an influence on the magnitude relationship.

Charging biases V1, V2, and V3 satisfy the following Inequality (2).

$$|V2| \leq |V3| < |V1| \quad (2)$$

where V1 (V) is a charging bias (hereinafter image-forming period charging bias) for forming the surface potential E1 of the region 1A in the photosensitive drum 1 at the transfer contact position C during an image-forming period, V2 (V) is a void-portion charging bias, and V3 (V) is a non-paper-feeding period charging bias.

The charging biases V1, V2, and V3 may be set so as to satisfy Inequality (2). Thus, unevenness in potential can advantageously be prevented.

Setting a proper transfer bias and charging bias can improve unevenness in potential. In view of the results on Table 1, unevenness in potential tends to be improved with a transfer bias of 1400 V or higher. However, from the viewpoint of black spots as described above, it is not desirable to apply an excessively large transfer bias to the void portion D, and a transfer bias of 1200 V or lower may be applied thereto.

Next, a rise of a transfer bias caused when the transfer bias changed from a non-paper-feeding period to an image-forming period will be examined. Immediately before a paper leading edge reaches the transfer contact position C, the transfer roller 5 is in contact with the photosensitive drum 1, which corresponds to the non-paper-feeding period as described above. Because the transfer roller 5 has an inherent electrical resistance, it is important for the transfer roller 5 to have a large transfer bias before the paper leading edge reaches there in consideration of a certain amount of time lag until the transfer bias changes to a desirable transfer bias. Therefore, in consideration of black spots, unevenness in potential, and the rise of the transfer bias, a transfer bias in a range from 1200 V to 1800 V is desirably applied to the void portion D. From viewpoints of black spots, unevenness in potential, and fog and in view of results on Table 1 and Table 2 and FIG. 3, the charging bias difference is desirably set in a range from 25 V to 75 V. These settings can maintain practically negligible problem levels of black spots and unevenness in potential and, at the same time, can prevent the fog as negligible as possible on the resulting image.

The values of the transfer bias and charging bias are given here merely for illustration purpose. In other words, the set values therefor may be controlled based on a detected environment that the image forming apparatus 100 is used and detected electrical resistances, which will be described below, against many variations of the environment and frequency in which the image forming apparatus 100 is used and of physical property values of electrical resistance of the transfer roller 5 and the toner charged state, for example. Based on the results on Table 1, a proper value of a transfer bias at paper leading-edge reaching time is calculated where the transfer bias during a non-paper-feeding period is 800 V and the transfer bias during an image-forming period is 2200 V with a charging bias difference of 50 V. The calculation is performed by assuming that the transfer bias during the non-paper-feeding period is 0% and the transfer bias during the image-forming period is 100%. In this case, a transfer bias in a range from 14% to 71% at the void portion D can maintain practically negligible problem level of density and black spots and, at the same time, can improve the unevenness in potential. When the image-forming period transfer bias is T1 (V), the non-paper-feeding period transfer bias is T2 (V), and the void-portion transfer bias is T3 (V), the transfer biases T1, T2, and T3 satisfy the following Inequality (3).

$$0.14 \leq (T3-T2)/(T1-T2) \leq 0.71 \quad (3)$$

Setting the transfer biases T1, T2, and T3 so as to satisfy Inequality (3) can prevent the three types of adverse effect in an image including density reduction, black spots, and unevenness in potential.

Here, the non-paper-feeding period transfer bias T2 may change the transfer current I to be fed to the photosensitive drum 1, which changes the absolute value of the surface potential of the photosensitive drum 1 to which the transfer bias is applied. This means that the proper values of the void-portion charging bias V2 and the image-forming period charging bias V1 are changed. Because this changes the absolute value of the charging bias, the value of the charging bias may be set in accordance with the transfer biases.

Bias Control During Print Job

Based on the relationship between the adverse effects in an image and applied biases, bias control to be applied during a print job will be described with reference to FIG. 4 and FIG. 5.

Figure 4:
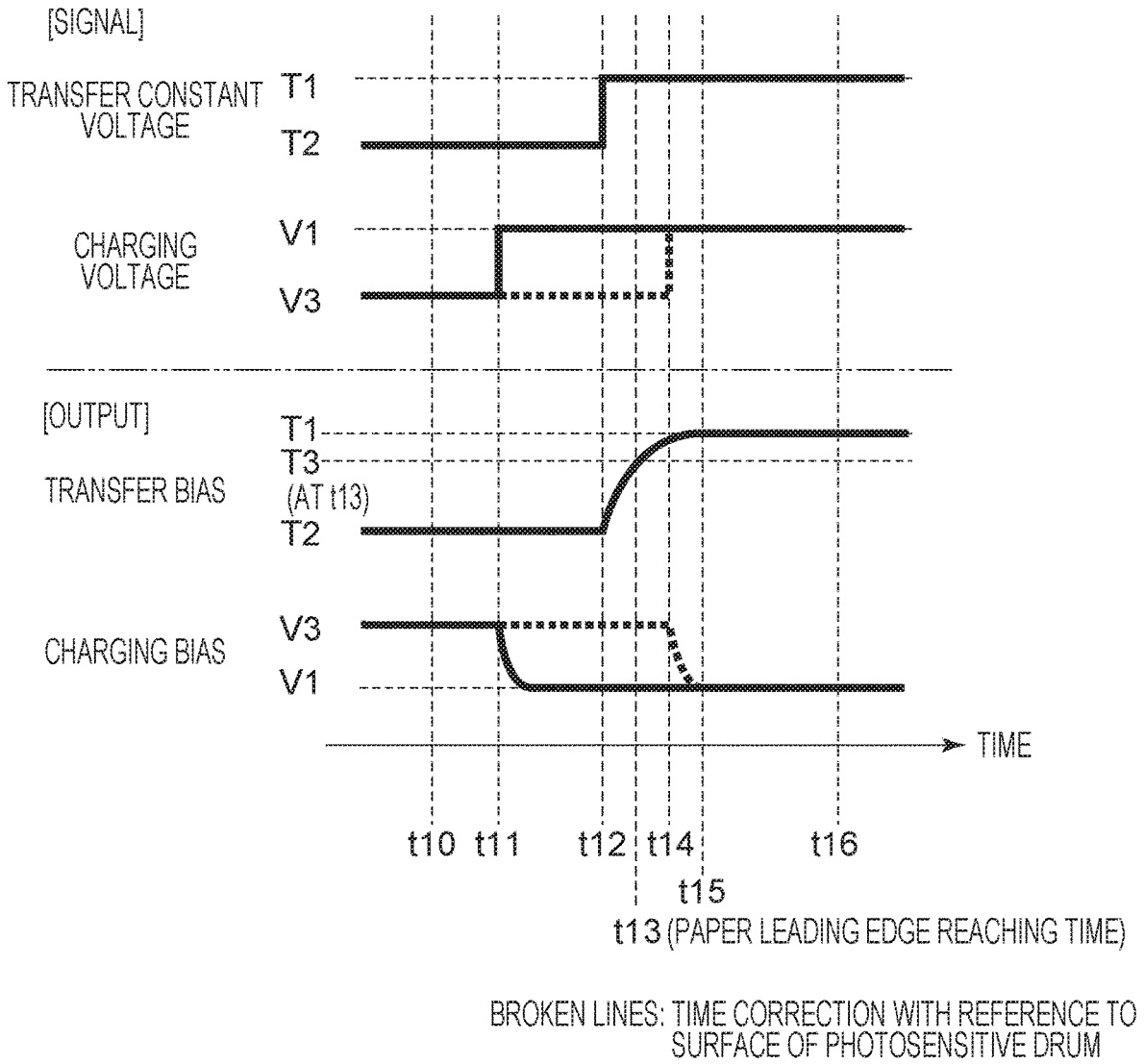
FIG. 4 is a timing chart for performing a print job according to Embodiment 1.
Figure 5:
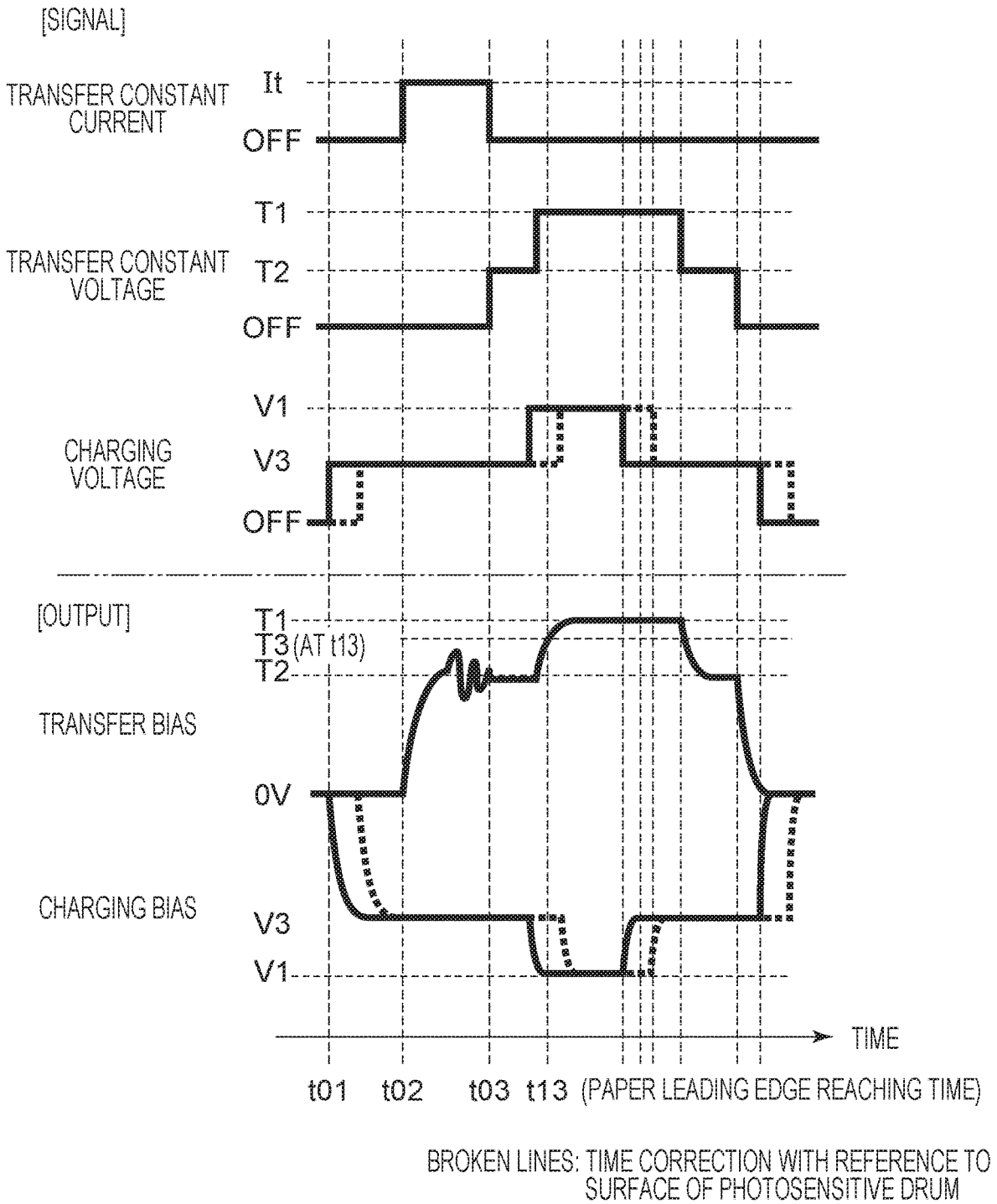
FIG. 5 is a timing chart for performing a printing operation according to Embodiment 1.

FIG. 4 and FIG. 5 are timing charts during a print job, and FIG. 4 illustrates detail times before and after a paper leading edge reaches in FIG. 5. FIG. 4 and FIG. 5 have vertical axes each indicating signals transmitted from the controller 9 and values to be output to the charging roller 2 and the transfer roller 5 in association with the charging bias and the transfer bias. FIG. 4 and FIG. 5 further have horizontal axes each indicating time, and the time passes from left to right in FIG. 4 and FIG. 5. The broken lines in FIGS. 4 and 5 indicate graphs with corrected elapsed time of the charging bias by a time tor a circumferential length from the charging contact position A to the transfer contact position C with reference to the circumferential position of the photosensitive drum 1. Because the distance from the charging contact position A to the transfer contact position C is equal to 50 mm and the rotation speed of the photosensitive drum 1 is equal to 100 mm/sec, there is a time lag of 500 msec until the part to which the charging bias is applied reaches the transfer contact position C. The solid-line graphs are corrected by the time lag, which is indicated by the broken line graphs.

First, a bias control upon start of a print job will be described with reference to FIG. 5. When a print job is transmitted to the controller 9, a motor, not illustrated, drives so that the photosensitive drum 1 rotates. When the photosensitive drum 1 rotates, a signal is transmitted at a time t01 which applies a non-paper-feeding period charging bias V3 (third charging bias) that is a predetermined value as a charging bias. With this, the charging bias is output, and the output value of the charging bias rises in a slopewise manner in association with the electrical resistance of the charging roller 2.

In consideration of the rotation of the photosensitive drum 1 from the charging contact position A to the transfer contact position C and the rise of the charging bias, a signal for applying a predetermined electric current value It to the transfer roller 5 at a time t02 after the surface potential of the photosensitive drum 1 is stabled at a predetermined value. With this, the transfer bias is applied. However, like the charging bias, because of the electrical resistance and contained moisture of the transfer roller 5, the output value of the transfer bias also rises in a slopewise manner and is stabled at a predetermined average value. The average value is derived as a non-paper-feeding period transfer bias T2 (second transfer bias) and is stored in the controller 9. The non-paper-feeding period transfer bias T2 varies in accordance with the electrical resistance characteristic of the transfer roller 5. Therefore, the current electrical resistance characteristic of the transfer roller 5 can be judged from the value of the non-paper-feeding period transfer bias T2. Here, +800 V is applied as the non-paper-feeding period transfer bias T2. After the non-paper-feeding period transfer bias T2 is derived, the control over the transfer bias is changed to a constant-voltage-control over the non-paper-feeding period transfer bias T2 at a time t03.

In this case, the absolute value of the non-paper-feeding period transfer bias T2 is set lower than that of the image-forming period transfer bias T1 (first transfer bias). This is because, as described above, a larger transfer bias during a non-paper-feeding period can prevent black spots due to a caused abnormal discharge. Also, the absolute value of the non-paper-feeding period charging bias V3 is set lower than that of the image-forming period charging bias V1 (first charging bias). This can prevent changes in halftone density due to unevenness in potential caused by changes of the surface potential after an image-transfer because the transfer bias changes before and after paper is fed. Here, the non-paper-feeding period charging bias V3 is lower in absolute value by 50 V than the image-forming period charging bias V1.

Then, after the region 1C of the surface in the photosensitive drum 1 having a potential formed by application of the non-paper-feeding period charging bias V3 passes by the transfer contact position C and before the region 1C passes by the transfer contact position C again, the region 1C is charged by the charging roller 2 to which the image-forming period charging bias V1 is applied.

Next, with reference to FIG. 4, bias controls to be performed from sheet feeding to image forming will be described. After paper is conveyed from a paper feeding cassette, not illustrated, the recording-material detecting member 8 detects a paper leading edge position at a time t10. The acquired leading edge position information is transmitted to the controller 9 so that a time (paper leading-edge reaching time) t-13 when the paper leading edge reaches the transfer contact position C can be estimated. After that, at a time t11, the charging bias is changed from the non-paper-feeding period charging bias V3 to the image-forming period charging bias V1. At a time t12, the transfer bias is changed from the non-paper-feeding period transfer bias T2 to the image-forming period transfer bias T1. In this case, with reference to the estimated paper leading-edge reaching time t13, the charging bias changing time t11 and the transfer bias changing time t12 are set. In consideration of the rise of the transfer bias, the transfer bias changing time t12 is reset such that the transfer bias T3 (third transfer bias) can be a value between the non-paper-feeding period transfer bias T2 and the image-forming period transfer bias T1 at a paper leading-edge reaching time t13. In this case, based on the electrical resistance characteristic acquired by the constant-current-control as described above, how the transfer bias rises is estimated, and the transfer bias changing time t12 is finally determined. A void has been formed at the paper leading-edge reaching time t13, and it is adjusted such that the transfer bias T3 to be applied to the void portion can be 1400 V. Also, in consideration of the time lag caused by the rotation of the photosensitive drum 1 from the charging contact position A to the transfer contact position C, the charging bias changing time t11 is determined such that the charging bias is changed at a time t14 after the paper leading-edge reaching time t13 with reference to the surface of the photosensitive drum 1. Thus, at the paper leading-edge reaching time t13, the transfer bias can have a value between the value during the non-paper-feeding period and the value during the image-forming period, causing a charging bias difference. Because the paper leading edge reaches the transfer contact position C at the time t13, the period for forming the void portion D is set such that is between the time t13 and the t14 including the time t13 and that the void portion transfer bias T3 is applied.

The transfer bias and charging bias at a time t15, rises up to the image-forming period transfer bias T1 and image-forming period charging bias V1, and image forming is started at a time t16. Here, the time t15 is to be before the back end of a margin at the paper leading edge reaches the transfer contact position C. According to Embodiment 1, +2200 V is applied as the image-forming period transfer bias T1. If the charging bias does not rise before the image forming start time t16 and changes gradually after that, the absolute value of the surface potential of the photosensitive drum 1 gradually increases, resulting in gradations in halftone. Also when the transfer bias does not rise, the density becomes lower at an image leading edge. According to Embodiment 1, the margin is set as 5 mm. Because the photosensitive drum 1 has a rotation speed of 100 mm/sec, there is a time lag of 50 msec from the paper leading-edge reaching time t13 to the image forming start time t16. Thus, the transfer bias and the charging bias are set to rise during the 50-msec time lag. This can prevent the density change in halftone as described above and transfer defects. From this, the time period from a change to a rise of the bias may be estimated and may be compared with the time lag for the margin so that the charging bias changing time t11 and the transfer bias changing time t12 can be adjusted. According to Embodiment 1, the transfer bias and the charging bias rise simultaneously at the time t15. However, one of them may rise first.

Figure 6:
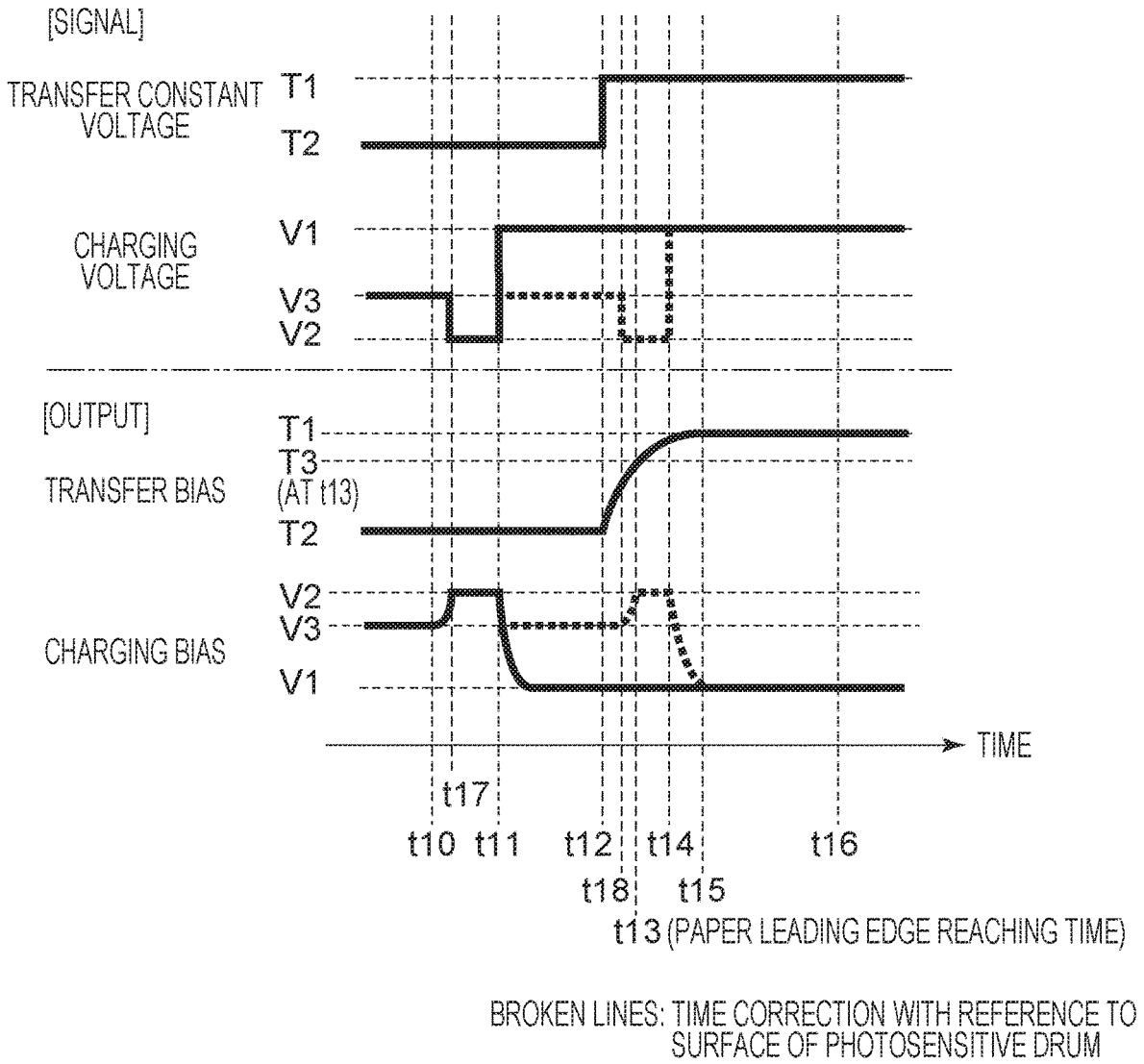
FIG. 6 is a timing chart for performing a print job according to Embodiment 1.

FIG. 4 and FIG. 5 illustrate the case where the non-paper-feeding period charging bias V3 and the void-portion charging bias V2 (second charging bias) are equal. However, the effect of prevention of the adverse effects in an image can be increased in a case where the void-portion charging bias V2 is lower than the non-paper-feeding period charging bias V3. The timing for applying the charging bias in the case will be described with reference to FIG. 6 based on FIG. 4. Because the operation for changing the transfer bias is performed in the same timing as described above, any repetitive description will be omitted.

When paper P is conveyed from a paper feeding cassette, not illustrated, the recording-material detecting member 8 detects a paper leading edge position at a time t10. The acquired leading edge position information is transmitted to the controller 9 so that the paper leading-edge reaching time t13 to the transfer contact position C can be estimated. After that, at a time t17, the charging bias is changed from the non-paper-feeding period charging bias V3 to the void-portion charging bias V2. At a time t11, the charging bias is changed from the void-portion charging bias V2 to the image-forming period charging bias V1. With reference to the paper leading-edge reaching time t13, a time t17 for applying the void-portion charging bias V2 for forming the surface potential of the photosensitive drum 1 having a void at the t13 and the time t11 for changing from the void-portion charging bias V2 to the image-forming period charging bias V1 are set. In consideration of the time lag caused by the rotation of the photosensitive drum 1 from the charging contact position A to the transfer contact position C, the times t17 and t11 are determined such that the charging bias is changed at a time t18 and a time t14 before and after the paper leading-edge reaching time t13 with reference to the surface of the photosensitive drum 1. Thus, at the paper leading-edge reaching time t13, the void-portion charging bias V2 can have a value lower than the value of the non-paper-feeding period charging bias V3, causing a charging bias difference, that is, a difference due to the surface potential of the photosensitive drum 1. Here, the void-portion charging bias V2 is lower in absolute value by 75 V than the image-forming period charging bias V1.

Then, after the region 1B having a void portion having a potential generated by the void-portion charging bias V2 applied to the charging roller 2 passes by the transfer contact position C and before it passes by the transfer contact position C again, the region 1B is charged by the charging roller 2 to which the image-forming period charging bias V1 is applied.

The abnormal discharge and unevenness in potential at the void portion D at the transfer contact position C can be prevented, as described above, by changing the charging bias based on the positional relationship among the photosensitive drum 1, the transfer roller 5 and the paper P. More specifically, the region 1C of the surface of the photosensitive drum 1 in contact with the transfer roller 5 before the leading edge of the paper P enters to the transfer contact position C is controlled to have the potential E3 with the charging roller 2 to which the third charging bias V3 is applied. After that, the leading edge of the paper P enters to the transfer contact position C. When the leading edge of the paper P exists at the transfer contact position C, a void portion D is formed by the surface of the photosensitive drum 1, the surface of the transfer roller 5 and the leading edge of the paper P at the transfer contact position C. The region 1B of the surface of the photosensitive drum 1 having the void portion D is controlled to have the potential E2 with the charging roller 2 to which the second charging bias V2 is applied. At the transfer contact position C, the region 1A of the surface of the photosensitive drum 1 in contact with the transfer roller 5 forming a transfer nip for transferring a toner image to the paper P is controlled to have the potential E1 with the charging roller 2 to which the first charging bias V1 is applied. In this case, the charging biases V1, V2, and V3 satisfy the relationship expressed in Inequality (2). Thus, the difference between the charging bias V2 which charges the region 1B in advance and the charging bias V1 which charges the region 1B when the region 1B reaches again is increased so that a larger potential difference can be provided between the surface potential of the photosensitive drum 1 and the potential of the charging roller 2. Therefore, the potential difference between the surface potential E2 of the region 1B and the potential of the transfer roller 5 may be reduced to prevent abnormal discharge at the void portion D. The region 1B may be charged by the charging roller 2 to which the charging bias V1 is applied before the region 1B passes by the transfer contact position C and then passes by the transfer contact position C again so that the potential difference can be increased, which can improve the unevenness in potential.

The simultaneous changes of the charging bias and the transfer bias can advantageously prevent the abnormal discharge and the unevenness in potential in the void portion D at the transfer contact position C. More specifically, before the leading edge of the paper P enters to the transfer contact position C, the second transfer bias T2 is applied to the region 1C of the surface of the photosensitive drum 1, and the region 1C in contact with the transfer roller 5 is controlled to have the potential E3 with the charging roller 2 to which the third charging bias V3 is applied. Until the void portion D is formed by the leading edge of the paper P entering to the transfer contact position C before a toner image is transferred to the photosensitive drum 1 at the transfer contact position C, a third transfer bias T3 equal to or higher than a first transfer bias T1 and equal to or lower than a second transfer bias T2 is applied thereto. The region 1B of the surface of the photosensitive drum 1 having the void portion D is controlled to have the potential E2 with the charging roller 2 to which the second charging bias V2 is applied. While the toner image is being transferred to the paper P at the transfer contact position C, the first transfer bias T1 is applied so that the region 1A of the surface of the photosensitive drum 1 forming the transfer nip is controlled to have the potential E1 with the charging roller 2 to which the first charging bias V1 is applied. In this case, the charging biases V1, V2, and V3 satisfy the relationship expressed in Inequality (2). Among the transfer biases, the second transfer bias T2 is equal to 0 V or has the same polarity as that of the first transfer bias T1 and is lower in absolute value than the first transfer bias T1.

By controlling the charging biases and the transfer biases, good image quality without abnormal discharge and unevenness in potential can be achieved. While the void portion D is being formed, a third transfer bias T3 equal to or higher than a first transfer bias T1 and equal to or lower than a second transfer bias T2 may be applied to prevent occurrence of abnormal discharge and to level unevenness in potential. In particular, when those charging biases and transfer biases satisfy the conditions expressed by the following Inequalities (4) to (5), large advantages are provided.

$$|V2| \leq |V3| < |V1| \quad (2)$$

$$0.14 \leq (T3-T2)/(T1-T2) \leq 0.71 \quad (3)$$

$$1200V \leq T3 \leq 1800V \quad (4)$$

$$25V \leq |\Delta V(=|V1|-|V2|)| \leq 75V \quad (5)$$

The time lag and the image forming starting time depend on the rotation speed of the photosensitive drum 1 and the length of the leading edge margin part of paper orthogonal to the axis of rotation of the photosensitive drum 1. Accordingly, the times for changing the transfer biases and charging biases may depend on the rotation speed of the photosensitive drum 1 and the length of the leading edge margin part of paper in the paper conveyance direction.

Even in a margin part on which image forming is not to be performed, a fog may occur if a development bias is applied. This may get worse when the charging bias does not fully rise and the surface potential of the photosensitive drum 1 is low. Therefore, when the charging bias is set not to fully rise in a paper leading edge part as described above, fog gets worse in the margin part. Against this problem, a development bias may be applied substantially at the same time as the start of image forming with reference to the surface of the photosensitive drum 1. In this case, the rise of the development bias has a time lag due to a predetermined electrical resistance. Therefore, the development bias is set to rise slightly earlier than start of image forming. According to Embodiment 1, the development bias is set to rise earlier by 5 msec than the starting time of image forming with reference to the surface of the photosensitive drum 1. This can improve unevenness in potential and, at the same time, can prevent the fog in a margin part.

Figure 7:
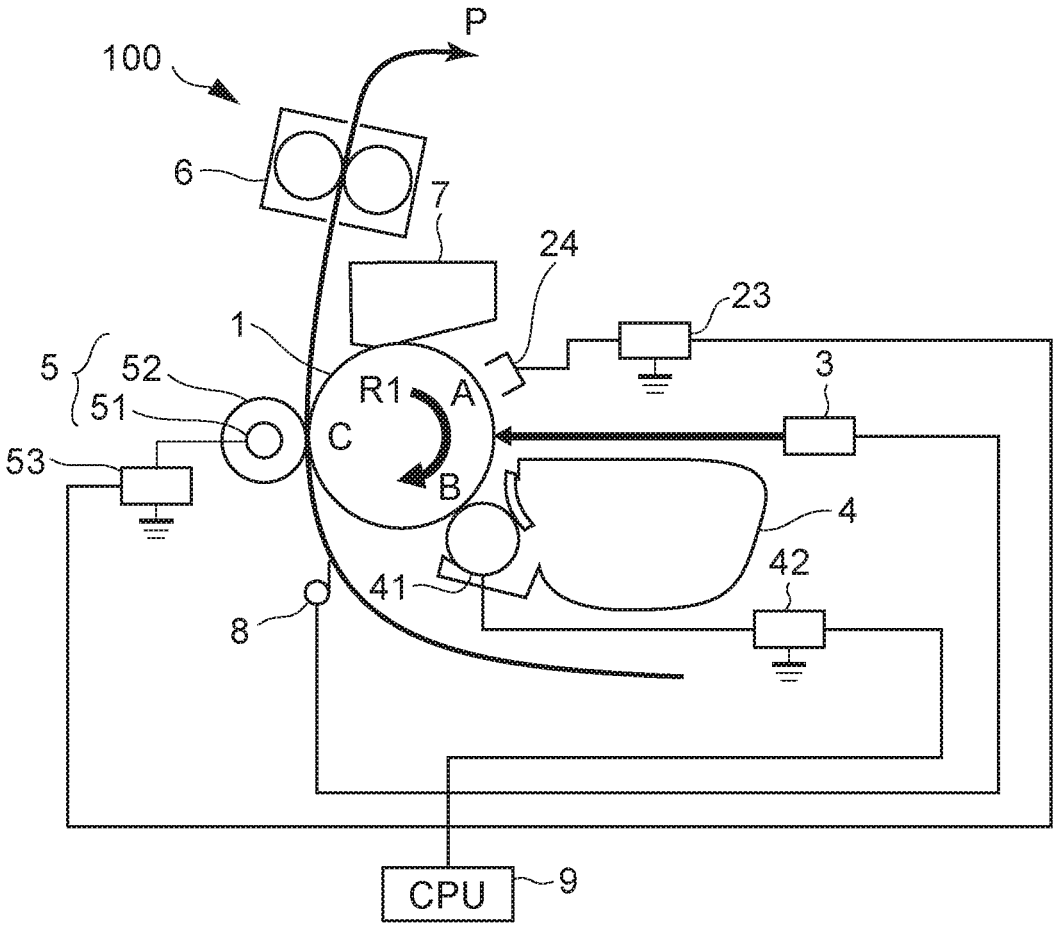
FIG. 7 is a schematic cross-sectional view illustrating a configuration of the image forming apparatus according to Embodiment 1.

According to Embodiment 1, the charging roller 2 configured to be in contact a conductive rubber member with the photosensitive member is used as a charging member. However, as such a charging member, a corona discharging member 24 may be used as illustrated in FIG. 7. Also in this case, application of the present disclosure enables a satisfactory level of density and black spots and can prevent unevenness in potential.

According to Embodiment 1, direct current voltage is applied as a bias to the charging roller 2 based on a direct current charging method. However, alternating current voltage may be supplied based on an alternating current charge method. Such an alternating current charge method can originally improve the effect for leveling the unevenness in potential of the surface of the photosensitive drum 1 but not sufficiently, compared with a direct current charge method. In this case, application of the present disclosure can improve the level of the unevenness in potential.

According to Embodiment 1, pre-exposure configuration is not adopted which has an exposure member on an upstream side of the photosensitive drum 1 in the rotational direction with respect to the charging roller 2. However, the pre-exposure configuration may be adopted. Adoption of such a pre-exposure configuration can originally improve the effect for leveling the unevenness in potential of the surface of the photosensitive drum 1 but not sufficiently. In this case, application of the present disclosure can improve the level of the unevenness in potential.

In addition, according to Embodiment 1, in consideration of the serially and slopewise rise of the transfer bias due to the electrical resistance of the transfer roller 5, the transfer bias T3 is applied between that in the non-paper-feeding period and that in the image-forming period is applied at the paper leading-edge reaching time. However, the signal of the rise of the transfer bias may be a transfer bias having a signal that rises in a stepwise manner. This may increase the time for applying a larger transfer bias than Embodiment 1 and the transfer bias T2 during the non-paper-feeding period and may slightly lower the level of black spots while the application of the transfer bias T3 can maintain black spots practically at negligible level in combination with the control of the charging bias.

According to Embodiment 1, toner which charges to a negative polarity is used as a developer. On the other hand, toner which charges to a positive polarity may be used. In this case, application of the present disclosure is with a charging bias of a positive polarity and a transfer bias of a negative polarity. However, biases to be applied during a non-paper-feeding period and an image-forming period have the same magnitude relationship as that of Embodiment 1 in absolute value. Also in this case, application of the present disclosure enables a satisfactory level of density and black spots and can prevent unevenness in potential.

Embodiment 2

Figure 8:
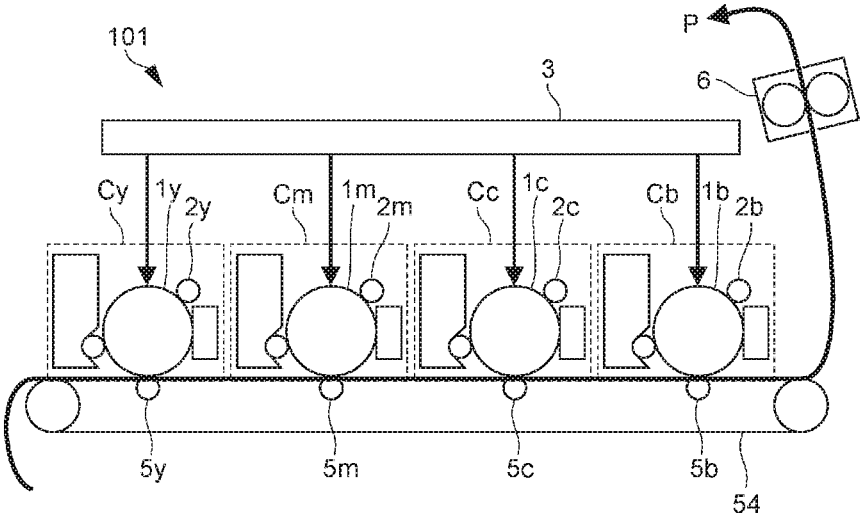
FIG. 8 is a schematic cross-sectional view illustrating a configuration of an image forming apparatus according to Embodiment 2.

According to Embodiment 1, a monochrome image forming apparatus 100 is used which includes roller-shaped transfer member 5 configured to transfer a toner image on a surface of the photosensitive drum 1 onto paper P. On the other hand the present disclosure is also applicable to a full-color image forming apparatus 101 including a belt-shaped transfer member (transfer belt) 54 as illustrated in FIG. 8.

The image forming apparatus 101 has process cartridges Cy, Cm, Cc, and Cb storing toners of yellow y, magenta m, cyan c, and black b and detachably attached to the apparatus main body. A part of a printing operation is executed with the process cartridges Cy, Cm, Cc, and Cb attached to the apparatus main body. The transfer member 54 has transfer rollers 5*y*, 5*m*, 5*c*, and 5*b* provided as conductive pressure adjusting member at positions facing photosensitive drums 1*y*, 1*m*, 1*c*, and 1*b* of the process cartridges Cy, Cm, Cc, and Cb. Transfer voltage applying units, not illustrated, are connected to the transfer rollers 5*y*, 5*m*, 5*c*, and 5*b*. A transfer bias is applied to the process cartridges Cy, Cm, Cc, and Cb through the transfer member 54 as a signal transmitted from a controller, not illustrated. Because the rest of the configuration is the same as that of Embodiment 1, any repetitive detail descriptions will be omitted. While the image forming apparatus 101 illustrated in FIG. 8 have charging rollers 2*y*, 2*m*, 2*c*, and 2*b* functioning in the same manner as that of the charging roller 2 in Embodiment 1, they may be replaced by the corona discharging member 24 as the charging member as in Embodiment 1.

Also with the configuration of Embodiment 2, because toner is directly transferred from the photosensitive drums 1*y*, 1*m*, 1*c*, and 1*b* onto paper, application of the present disclosure enables a satisfactory level of density and black spots and can prevent unevenness in potential.

While the disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2018-007277, filed Jan. 19, 2018, which is hereby incorporated by reference herein in entirety.

What is claimed is:

1. An image forming apparatus comprising:

a rotatable image bearing member;

a charging member configured to charge a surface of the image bearing member;

a transfer member configured to transfer a toner image formed on the surface of the image bearing member onto a recording material;

a charging voltage applying unit configured to apply charging voltage to the charging member;

a transfer voltage applying unit configured to apply transfer voltage to the transfer member; and a control unit configured to control voltage to be applied from the charging voltage applying unit and the transfer voltage applying unit and a printing operation, wherein a nip portion configured to hold the recording material is formed between the transfer member and the image bearing member, wherein the control unit controls the charging voltage and the transfer voltage to be applied by the charging voltage applying unit and the transfer voltage applying unit during a period from start of an operation for forming the toner image onto the image bearing member to completion of an operation for transferring the toner image onto the recording material, the charging voltage applying unit is capable of applying to the charging member a first charging voltage, a second charging voltage having a same polarity as that of the first charging voltage and being lower in absolute value than the first charging voltage, and a third charging voltage being equal to or higher in absolute value than the second charging voltage, and the transfer voltage applying unit is capable of applying to the transfer member a first transfer voltage and a second transfer voltage being equal to 0 V or having a same polarity as that of the first transfer voltage and being lower in absolute value than the first transfer voltage, wherein, while the toner image is being transferred onto the recording material at the nip portion, the transfer voltage applying unit applies the first transfer voltage to the transfer member, and the surface of the image bearing member forming the nip portion has a potential when the charging voltage applying unit applies the first charging voltage to the charging member, before a leading edge of the recording material enters to the nip portion, the transfer voltage applying unit applies the second transfer voltage to the transfer member, and the surface of the image bearing member in contact with the transfer member has a potential when the charging voltage applying unit applies the third charging voltage to the charging member, when the leading edge of the recording material is present within the nip portion after the leading edge of the recording material enters to the nip portion, a void is formed by the surface of the image bearing member, a surface of the transfer member and the leading edge of the recording material within the nip portion, and during a period before the toner image is transferred to the recording material at the nip portion and until the void is formed, the transfer voltage applying unit applies to the transfer member the first transfer voltage, the second transfer voltage, or a third transfer voltage having a magnitude between the first transfer voltage and the second transfer voltage, and the surface of the image bearing member forming the void has a potential when the charging voltage applying unit applies the second charging voltage to the charging member.

2. The image forming apparatus according to claim 1, wherein the control unit controls such that, after the charging voltage applying unit forms a potential by applying the second charging voltage to the charging member and the surface of the image bearing member forming the void at the nip portion passes through the nip portion and before the surface passes through the nip portion again, the charging voltage applying unit applies the first charging voltage to the charging member.

3. The image forming apparatus according to claim 1, wherein, before the void is formed, the control unit controls to continuously change the transfer voltage to be applied to the transfer member by the transfer voltage applying unit when the transfer voltage is changed from the second transfer voltage to the third transfer voltage.

4. The image forming apparatus according to claim 1, wherein, before the void is formed, the control unit controls to change in a stepwise manner the transfer voltage to be applied to the transfer member by the transfer voltage applying unit when the transfer voltage is changed from the second transfer voltage to the third transfer voltage.

5. The image forming apparatus according to claim 1, wherein the control unit controls to change from the third transfer voltage to the first transfer voltage until a back end of a margin part at the leading edge of the recording material passes through the nip portion.

6. The image forming apparatus according to claim 1, further comprising:

a sensor configured to detect a position of the leading edge of the recording material, wherein the control unit controls a time for changing the transfer voltage and the charging voltage based on a time when the sensor detects the position of the leading edge of the recording material.

7. The image forming apparatus according to claim 6, wherein the control unit controls a time for changing the transfer voltage and the charging voltage based on a length of the margin part of the leading edge of the recording material in a direction orthogonal to an axis of rotation of the image bearing member and a rotation speed of the image bearing member.

8. The image forming apparatus according to claim 1, wherein the control unit controls a time for changing the transfer voltage based on an electrical resistance characteristic of the transfer member.

9. The image forming apparatus according to claim 1, wherein the control unit controls to satisfy $$0.14 \leq (T3-T2)/(T1-T2) \leq 0.71$$

where the first transfer voltage is T1 (V), the second transfer voltage is T2 (V), and the third transfer voltage is T3 (V).

10. The image forming apparatus according to claim 1, wherein the control unit controls to satisfy $$|V2| \leq |V3| < |V1|$$

where the first charging voltage is V1 (V), the second charging voltage is V2 (V), and the third charging voltage is V3 (V).

11. The image forming apparatus according to claim 1, wherein the charging member is in contact with the image bearing member and receives the charging voltage containing direct current voltage.

12. The image forming apparatus according to claim 11, wherein the charging voltage contains alternating current voltage.

13. The image forming apparatus according to claim 1, wherein the charging member charges the surface of the image bearing member by corona discharge.

14. The image forming apparatus according to claim 1, wherein the transfer member is a roller-shaped member having elasticity at its part in pressure contact with the image bearing member.

15. The image forming apparatus according to claim 1, wherein the transfer member is a belt-shaped rotatable member.

16. The image forming apparatus according to claim 1, wherein the control unit controls a magnitude of a difference between the first charging voltage and the second charging voltage based on a magnitude of the second transfer voltage.

17. The image forming apparatus according to claim 1, the control unit controls to satisfy $$1200V \leq T3 \leq 1800V, 25V \leq \Delta V \leq 75V$$

where the third transfer voltage is T3 (V) and the difference between the first charging voltage and the second charging voltage is ΔV (V).

18. An image forming apparatus comprising:

a rotatable image bearing member;

a charging member configured to charge a surface of the image bearing member;

a transfer member configured to transfer a toner image formed on the surface of the image bearing member onto a recording material;

a charging voltage applying unit configured to apply charging voltage to the charging member; and a control unit configured to control the charging voltage to be applied from the charging voltage applying unit and a printing operation, wherein a nip portion configured to hold the recording material is formed between the transfer member and the image bearing member, wherein the control unit controls the charging voltage to be applied by the charging voltage applying unit during a period from start of an operation for forming the toner image onto the image bearing member to completion of an operation for transferring the toner image onto the recording material, the charging voltage applying unit is capable of applying to the charging member a first charging voltage, a second charging voltage having a same polarity as that of the first charging voltage and being lower in absolute value than the first charging voltage, and a third charging voltage being equal to or higher than the second charging voltage in absolute value, wherein, before the leading edge of the recording material enters to the nip portion, the surface of the image bearing member in contact with the transfer member has a potential when the charging voltage applying unit applies the third charging voltage to the charging member, and when the leading edge of the recording material enters to the nip portion and the leading edge of the recording material is present within the nip portion, a void is formed by the surface of the image bearing member, a surface of the transfer member, and the leading edge of the recording material within the nip portion, and the surface of the image bearing member forming the void has a potential when the charging voltage applying unit applies the second charging voltage to the charging member, the surface of the image bearing member forming the nip portion while the toner image is being transferred to the recording material at the nip portion has a potential when the charging voltage applying unit applies the first charging voltage to the charging member.

19. The image forming apparatus according to claim 18, wherein the control unit controls such that, after the charging voltage applying unit forms a potential by applying the second charging voltage to the charging member and the surface of the image bearing member forming the void at the nip portion passes through the nip portion and before the surface passes through the nip portion again, the charging voltage applying unit applies the first charging voltage to the charging member.

20. The image forming apparatus according to claim 18, the control unit controls to satisfy $$|V2| \leq |V3| < |V1|$$

where the first charging voltage is V1 (V), the second charging voltage is V2 (V), and the third charging voltage is V3 (V).

* * * * *